US005458043A

United States Patent [19]

Jensen et al.

[11] Patent Number: 5,458,043

[45] Date of Patent: Oct. 17, 1995

[54] BATTERY CHARGING CAPACITORS ELECTROMAGNETIC LAUNCHER

[75] Inventors: Daniel B. Jensen, Albuquerque, N.M.; James B. Cornette, Austin, Tex.; Mark W. Heyse, Destin; Ronald E. Stearns, Esther, both of Fla.

[73] Assignee: The United States of America as represented by the Secretary of the Air Force, Washington, D.C.

[21] Appl. No.: 282,850

[22] Filed: Jul. 28, 1994

[51] Int. Cl.[6] ..... F41B 6/00

[52] U.S. Cl. ..... 89/8; 124/3

[58] Field of Search ..... 89/8; 124/3

[56] References Cited

U.S. PATENT DOCUMENTS

| | | | |
|---|---|---|---|
| 4,329,971 | 5/1982 | Kemeny et al. | 124/3 |
| 4,766,336 | 8/1988 | Deis et al. | 310/12 |
| 4,841,181 | 6/1989 | Kemeny et al. | 310/12 |
| 4,924,750 | 5/1990 | Neugebauer | 89/8 |

FOREIGN PATENT DOCUMENTS

| | | | |
|---|---|---|---|
| 39896 | 2/1991 | Japan | 124/3 |

OTHER PUBLICATIONS

Rosebrock et al., Rail Type Pulsed Plasma Accelration, "Circuit Description", FIG. 59, Apr. 1963, p. 93.

*Primary Examiner*—Stephen C. Bentley

*Attorney, Agent, or Firm*—George E. Kersey; William G. Auton; Jacob N. Erlich

[57] ABSTRACT

A rapid fire electromagnetic launcher system (EML) employs a plurality of capacitor modules which are charged by an equal number of modules of lead acid batteries. The invention comprises the combination of standard automotive lead acid batteries for charging an electrolytic capacitor array which is switched into an Electromagnetic Launcher (EML) by means of silicon controlled rectifiers, and a control circuit for controlling the loading and launching of projectiles at a very rapid rate. The system includes a multishot preinjector and rapid fire controller for operating the system in a safe and reliable manner. The system includes a preaccelerator, magazine and barrel. The combination eliminates the low power density limitation of the batteries, the requirement to repetitively commutate energy out of an inductor, and allows for a modular system than can be expanded to provide higher energy to each projectile in the burst.

4 Claims, 3 Drawing Sheets

BATTERY CHARGING CAPACITORS ELECTROMAGNETIC LAUNCHER

STATEMENT OF GOVERNMENT INTEREST

The invention described herein may be manufactured and used by or for the Government for governmental purposes without the payment of any royalty thereon.

BACKGROUND OF THE INVENTION

Electromagnetic launchers are well known in the art. However, none of the known prior art is capable of achieving the goal of launchings on the order of 1000 projectiles in under 10 minutes. To meet such a goal, the power supply must be capable of delivering the appropriate energy and power for 1,000 launching events, and the loader mechanism/barrel must also be capable of withstanding the same number of events if one barrel is used.

To accomplish the foregoing objectives, it was necessary to develop a system which included power supply components that are simple, modular, expandable, and generally available. The lead acid automotive battery and electrolytic capacitors meet these requirements. Prior electromagnetic launchers have used automotive lead acid batteries to charge an inductive store that must be switched repetitively. Several commutating switching schemes have been tried in the past, but these have not proven reliable or cost effective beyond a three to five shot burst. Eliminating the need for these commutating switching arrangements was another goal of this invention, and was accomplished using a combination of batteries charging an electrolytic capacitor array which is switched in the electromagnetic launcher with standard, off the shelf silicon controlled rectifiers. The use of this combination eliminates the low power density limitation of the batteries, the requirement to repetitively commutate energy out of an inductor, and allows for a modular system that can readily be expanded to provide higher energy to each projectile in the burst. In addition, it was necessary to provide a loading mechanism and a control system for controlling the operation of all the components.

PRIOR PATENTS

U.S. Pat. No. 4,329,971 issued to Kemeny et al;

U.S. Pat. No. 4,766,336 issued to Deis et al;

U.S. Pat. No. 4,841,181 issued to Kemeny et al; and

U.S. Pat. No. 4,924,750 issued to Neugenbauer.

The Kemeny et al patent '971 relates to a power system for electromagnetic propulsion. The power system comprises a source capable of producing high D.C. current, an induction coil for storing electromagnetic energy, and a switching means for opening and closing the circuit. The current source, inductance coil and switching means are electrically connected in series, and cooperate with turns associated with the induction coils to temporarily produce higher currents than those produced by the circuit including the current source.

The Deis et al patent discloses an electromagnetic launcher comprising a source of high current and first and second inductors. The second inductor is in the form of an augmenting winding adjacent the rails of the launcher. When the current through the inductors reaches a certain firing level, the current is commutated into the rails, and as the launcher projectile exits, the rails are removed from the electrical circuit in a manner such that inductive energy remaining the rails is inductively transferred to the second inductor. The first inductor is decoupled from the second inductor during the energy transfer to provide for an efficient energy transfer.

The Kemeny et al patent '181 relates to an electromagnetic launcher comprising a source of high current which includes a generator and energy storing inductance in series with the generator. A rail system is connected to the source of high current, and an armature for conducting current bridges the rails for accelerating a projectile when a current is commutated into the rails. Inductive energy remaining in the rail system after a launch is recovered and transferred back to the generator to increase the kinetic energy of the rotor thereof prior to a subsequent launch.

The Neugebauer patent discloses an inductor storage-type electromagnetic launcher in which the energy expended in propelling a mass through a breech rail gun section at a high velocity is utilized to generate a current in the breech section rails. The current flows through a cummutating switch in opposition to the inductor charging current. The switch is opened in coordination with the movement of a mass through the launcher with little of no arcing when the current therethrough has been depressed to a minimal level to commutate inductor discharging high exit velocity.

SUMMARY OF THE INVENTION

In summary, this invention is for a rapid fire electromagnetic launcher system (EML) using capacitor modules which are charged by modules of lead acid batteries. The system includes a multishot preinjector and rapid fire controller for operating the system in a safe and reliable manner. The invention comprises the combination of standard automotive lead acid batteries for charging an electrolytic capacitor array which is switched into an Electromagnetic Launcher (EML) by means of silicon controlled rectifiers, and a control circuit for controlling the loading and launching of projectiles at a very rapid rate. The system includes a preaccelerator, magazine and barrel. The combination eliminates the low power density limitation of the batteries, the requirement to repetitively commutate energy out of an inductor, and allows for a modular system than can be expanded to provide higher energy to each projectile in the burst.

OBJECTS OF THE INVENTION

An object of this invention is to provide an electromagnetic launcher capable of delivering on the order of 1000 launching event in a period of under 10 minutes.

Another object of this invention is to provide an electro magnetic, launching system having the needed energy and power for 1,000 rapid launches, a loader mechanism capable of withstanding such a large number of events, a switching system which does not require commutation, and a control system for controlling the operation of the system

BRIEF DESCRIPTION OF THE DRAWINGS

These and other advantages, objects and features of the invention will become more apparent after considering the following description taken in conjunction with the illustrative embodiment in the accompanying drawings, in which.

DETAILED DESCRIPTION OF A PREFERRED EMBODIMENT

Figure 1:
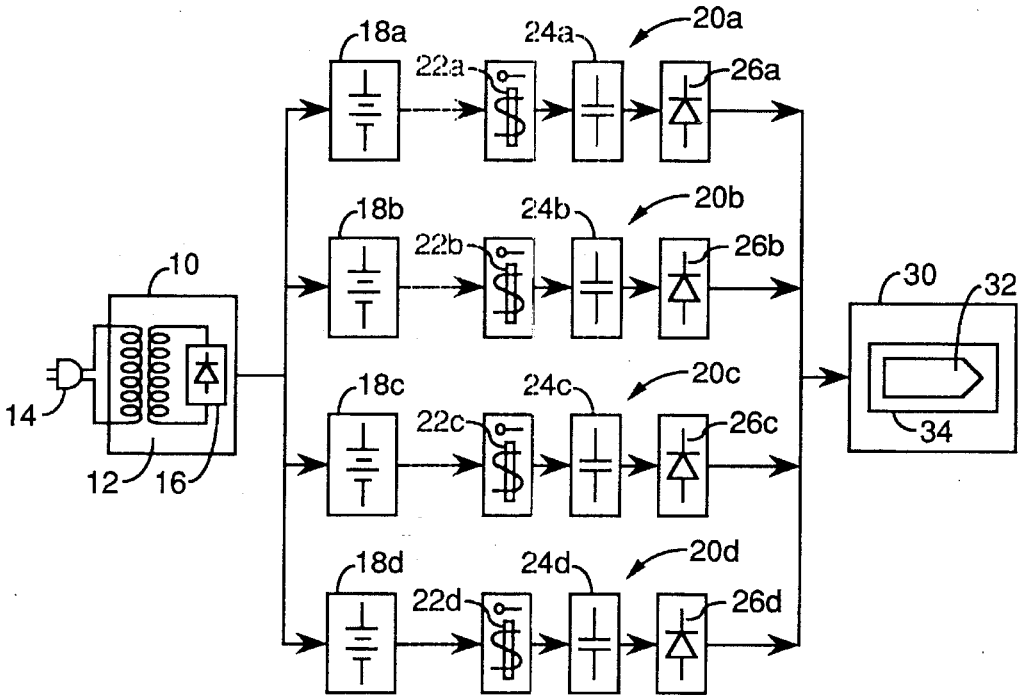
FIG. 1 is a schematic diagram of the launcher system.

Referring to FIG. 1, the system utilizes a high voltage battery charger 10, diagrammatically shown as including a transformer 12 connected to a power source 14. The charger is capable of supplying three to five amperes from the output of its rectifier system 16. As shown in FIG. 1, the charger 10 is used to charge four independent series battery strings 18*a* to 18*d* that normally may have from 10 to sixty batteries in series, depending on the size of the overall system requirements. The output from the battery strings 18*a* to 18*d* is then applied, respectively, to capacitor modules 20*a* to 20*d*, each of which includes a solenoid operated mechanical relay 22*a*–22*d* for connecting the battery strings to the capacitor modules. The modules 20*a–d* comprise banks of capacitors 24*a*–24*d* and silicon controlled rectifiers 26*a*–26*d*, which are eventually triggered to energize an electromagnetic launcher 30, of the type described in my earlier U. S. Pat. No. 5,078,042 incorporated herein by reference.

With the batteries charged at 12.76 volts per battery, which is defined as 100 percent state of charge (SOC), the series string ranges from 127 to 765 volts available to charge the capacitor modules 20*a* to 20*d*. In practice, the battery strings are trickle charged at low current periodically to keep a 100 percent state of charge. The coulomb transfer from the batteries during each capacitor module charging event is very small.

Each of the four capacitor modules 20*a–d* is charged by a separate battery module 18*a–d*. Each of the capacitance modules has an equivalent capacitance of 84 millifarads capable of storing 22 KJ at 720 V charge. In practice, each of the modules 20*a–d* was subdivided into four parallel drawers of twenty-four 3.5 mF electrolytic capacitors with a voltage rating of 450 V. The drawers each consisted of 12 parallel branches of two capacitors in series with an equivalent capacitance of 21 mF. To charge a capacitor module to 720 V requires 60 coulombs (C) of charge to be transferred from the batteries to the capacitors. Proportionally less charging is required at lower voltages. As shown, each battery module 18*a–d* charges the associated capacitor module through the solenoid operated mechanical relays 22*a*–22*d*, however, constant current charging via controlled transistors of appropriate size would be considered the equivalent of the relays 22*a–d*, if not preferable.

Upon closing of the relays 22*a–d*, the capacitor modules 20*a–d* are charged to 90 percent of the battery module voltage within 100 milliseconds (ms). The relative light duty cycle of the batteries can be understood by examining the coulomb discharge noting their 84 amp-hour or $3\times10^5$ C equivalent rating at 100 percent SOC. Consequently, a 1000 projectile burst requiring 6 coulombs per projectile would deplete four battery modules by $0.6\times10^5$ coulombs, and reduce the battery modules to 80 percent SOC.

Figure 4:
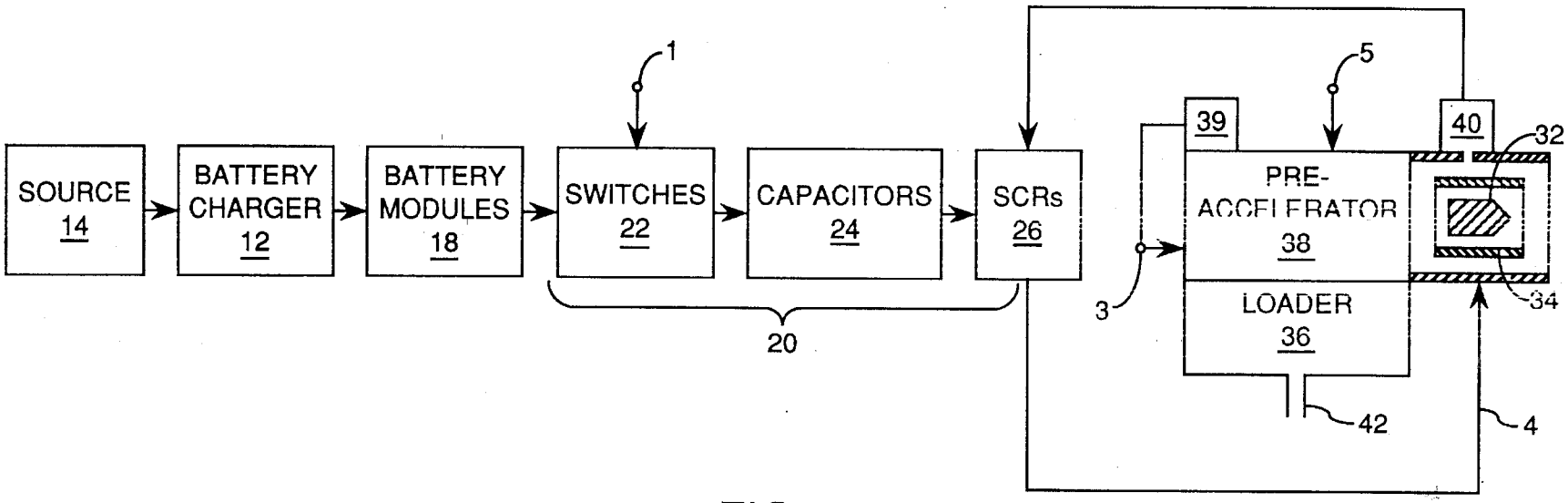
FIG. 4 is a diagram of the overall system.

Refer now to the block diagram of FIG. 4 which shows the overall system. As shown, the battery charger 12 is supplied from source 14 for charging the battery modules 18. When the switches 22 are closed by the application of a signal at terminal 1, the capacitors 24 in each bank of capacitors 20 are charged. In the meantime, a loader 36 which has been loaded with a plurality of projectiles 32 in their carriers 34 moves the projectiles and carriers into a preaccelerator 38 by means of the helium gas supplied under pressure at a port 42. When a projectile is sensed within the preaccelerator 38 by means of an optical sensor 39, acceleration is initiated by a signal applied at terminal 3. When the projectile is sensed within the EML 30 by a sensor 40, the SCRs are switched by means of a signal applied at terminal 4 to energize the EML and propel a projectile. Following the propelling of the projectile, a signal applied at terminal 5 causes ejection of the empty carrier.

When the capacitor modules 20*a–d* are fully charged, the control system for the launcher 30 verifies that a projectile 32 along with its carrier 34 has been loaded into the loader 36 and preaccelerated to a specific point in the breech of the barrel of the preaccelerator 38, the control system triggers all 16 silicon controlled rectifiers 26*a–d* located in each capacitor module 20*a–d* for the purpose of energizing the launcher 30. After the projectile is launched and the controller starts loading another projectile, the capacitor charging sequence is repeated.

Figure 2:
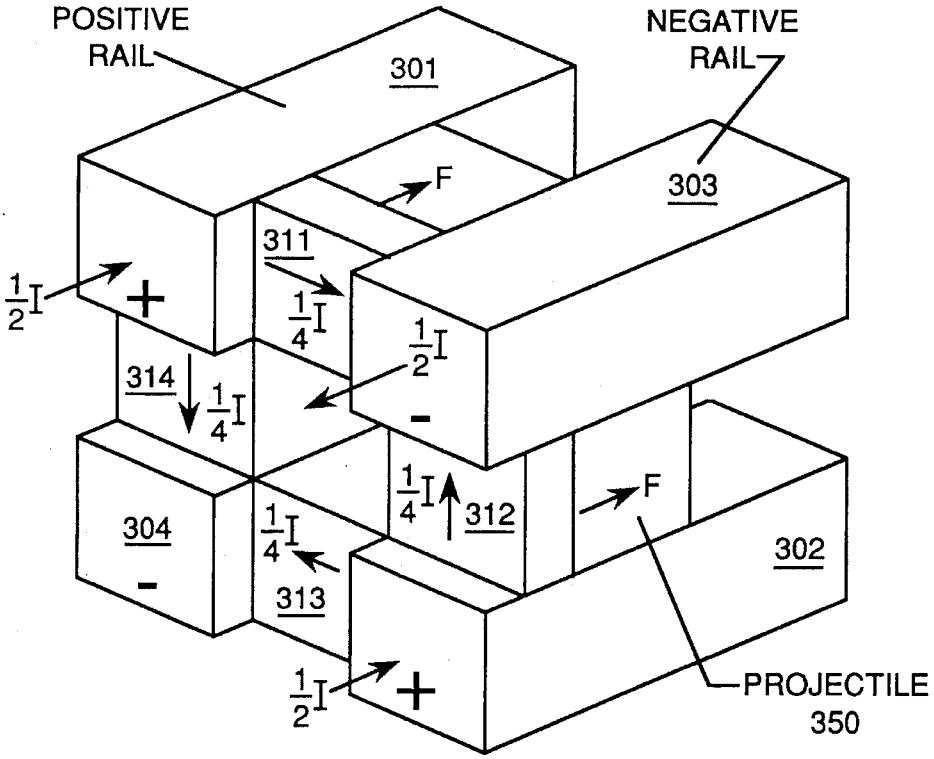
FIG. 2 is a drawing showing the general construction of a multiple armature rail launcher.

The electromagnetic launcher 30 used in the reduction to practice of this invention is a plasma utility gun capable of a variety of bore configurations and easily converted to rapid fire. As noted, the multiple armature rail gun configuration of the launcher 30 is fully described in my U.S. Pat. No. 5,078,042, a portion of which is reproduced in FIG. 2. Referring to FIG. 2, the launcher 30 includes a rail gun which uses four conducting rails 301–304, arranged in a quadri-pole configuration, to accelerate four conductive orthogonal armatures 311–314 to launch projectiles. The four conductive rails include two positive rails 301, 302 into which currents of ½ I are input, and two negative rails 303, 304 out of which currents of ½ I are received.

The four conductive orthogonal armatures 311–314 each conduct current of ¼ between a positive rail and a negative rail. These armatures slide along the positive and negative rails when accelerated by the magnetic field. Note that the source of high current for the rail gun is the capacitor modules 20*a*–20*d*.

In operation, the four conducting rails each generate a propelling magnetic field when conducting an operating current from the capacitor modules. Similarly the conducting armatures experience an electromotive force in the presence of the propelling magnetic field when they conduct the operating current between the rails. The sliding armatures are physically in contact with a projectile 32. The motion of the armatures serves to propel the projectiles. For additional information concerning the electromagnetic armature configuration, reference should be made to my aforementioned patent.

Figure 3:
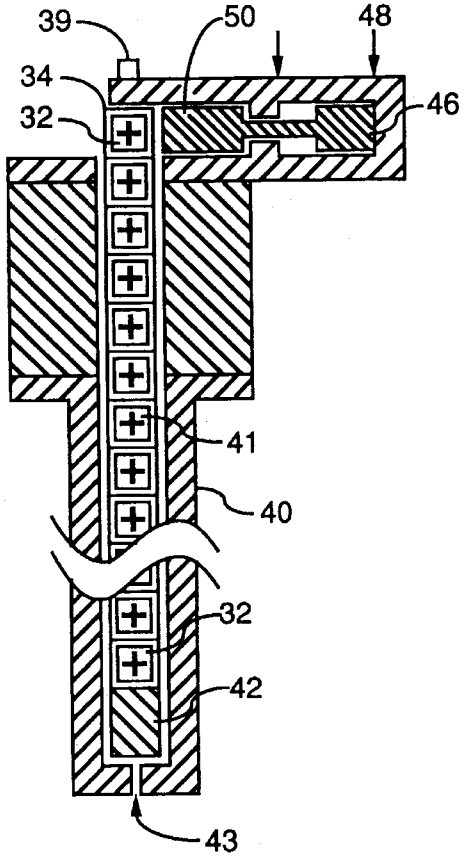
FIG. 3 shows a rapid fire 30 shot loader.

To inject and preaccelerate the projectiles, the preinjector, preaccelerator loader 40, shown in FIG. 3, is used. As shown, a plurality of projectiles 32, in their carriers 34 are stacked in the magazine 41 of loader 40 and are transported to the EML 30 (not shown in FIG. 3) by means of a piston 42, driven by a pressurized helium gas injected by means of a valve (not shown) through a port 43. When the projectile 32 is in position within the loader, high pressure helium is released by a valve (not shown) to accelerate projectile into the EML 30. The spent carriers 34 are ejected by means of a piston 46 supplied with high pressure helium at a port 48, and is returned by means of gas pressure supplied at a port 50.

To simplify loading, the projectiles are transported through the loader in carriers. The carriers protect the projectiles and the armature/initiation fuse from damage. Carriers can be made to carry various projectile shapes without changing the loader assembly. Projectile feeding is done with a piston the same shape as the carrier that push the carriers through the magazine with 80 psi pressure. When a new projectile is to be loaded into firing position, a carrier is ejected out of the loader. The controller energizes the ejector valve moving the ejector bed back. When the bed is past the carrier opening, the stack of carriers moves up until the carrier to be ejected blocks the loader sensor light beam 39. The controller de-energizes the ejector valve and the bed ejects the last carrier unblocking the loaded sensor. A new projectile is in firing position. The entire eject sequence takes about 150 ms at this pressure.

The projectile/armature is accelerated by helium gas. This is accomplished with a fast acting high pressure valve, a 33 cubic inch firing bottle, and a 2000 cubic inch reservoir bottle. When the valve is energized, gas from the firing bottle is released to accelerate the projectile and armature. When the projectile passes the first light gate, the valve is turned off. The firing bottle is then re-pressurized in approximately 25 ms by the reservoir bottle connected through a restrictive line. The 2000 cubic inch reservoir has the capacity for 30 shot bursts.

Figure 5:
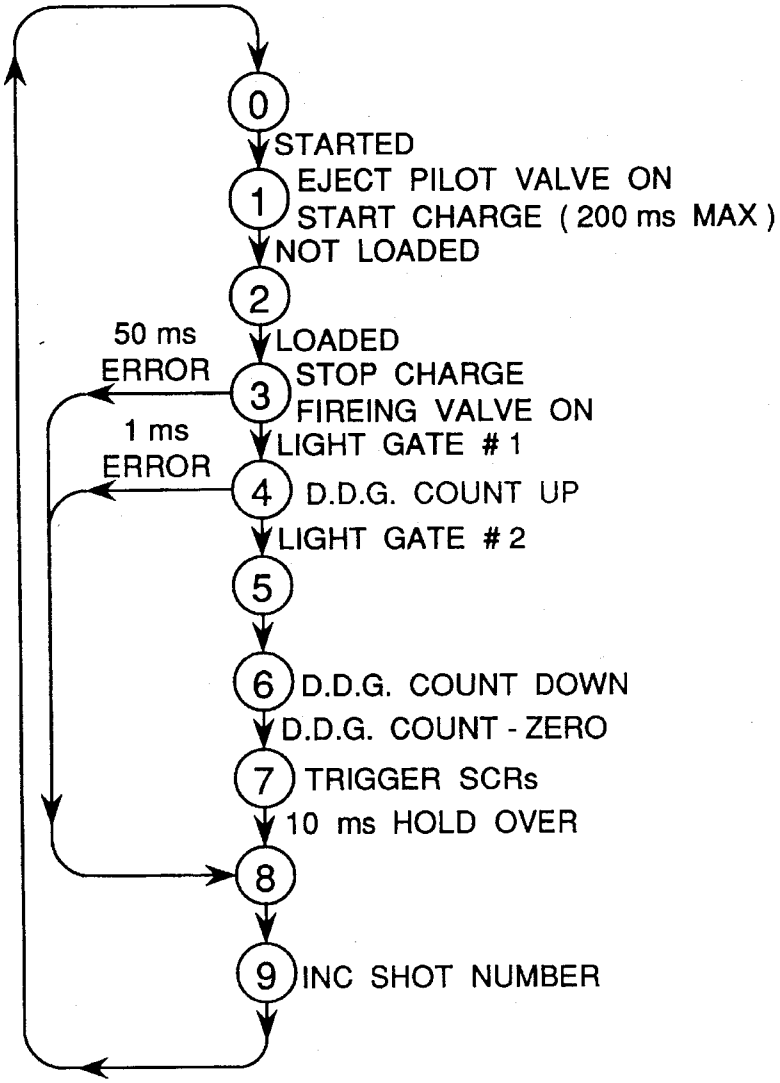
FIG. 5 is a schematic diagram showing the control system for the rapid fire system.

As shown in FIG. 5, the EML system and power supply are controlled by a rapid fire controller. The controller has four basic actions which it commands: 1) the charging of the capacitor modules, 2) firing of the preaccelerator, 3) the triggering of the SCR to power the EML, and 4) the ejection of an empty carrier which will allow now a new projectile to move into the ready position.

To perform these functions at the correct times the controller must sense several condition from the EML system. First, the controller must detect the firing command given by an operator. Second, the controller must sense that a projectile is in place, and third, the injection of the projectile is monitored by two optical sensors in the preacceleration flight tube. All inputs and outputs to the controller are made by means of fiber optic control line to provide isolation from electrical noise. FIG. 5 shows the controller's state diagram.

As shown in FIG. 5, the controller is designed to continuously cycle through ten states with each successful cycle firing a shot in the burst.

State 0 holds all action until and operator firing command is detected.

State 1 ejects a spent carrier, activates the capacitor charging relays, and begins a 200 ms timer.

State 2 holds for a signal that a new carrier is in the loaded position.

state 3 releases the charging relays and fires the gas injector valve. Between state 3 and state 4, the passage of the projectile in the injector flight tube is detected.

State 4, the distance delay generator is incremented by the system clock.

State 5 waits for the second light gate.

State 6 begins a count down of the distance delay generator DDG register.

State 7, when the count down reaches zero, triggers the SCRs, which trigger the capacitor bank discharge through the EML. There is a 10 ms hold between state 7 and state 8 to allow the EML current pulse and the muzzle arc to decay.

State 8 is a time delay.

State 9 increments the shot number and returns the controller to state 0.

Certain fault conditions are expected to damage the EML system. Leading among these condition is a capacitor bank discharge through a gun without the presence of a projectile or armature. For protection, three timing faults are hard wired into the controller. The first is for charge time. When the controller is in state 1 a 200 ms timer is started. If the loading sequence takes longer than the 200 ms the charge relays are opened. The second fault detector is for state 3. If the projectile is not detected passing light gate #1 within 50 ms from the time the injection gas valve is turned on, the controller will go to state 8 and start a new load sequence.

Because the injection velocity of the projectiles vary, the SCRs must be triggered when the projectile is at the same point in the bore for each shot. This is especially critical because the rails are covered with an insulating material in the power feed section of the EML. Triggering the SCRs at a given down bore position is accomplish with a distance display generator (DDG). The DDG logic assumes that the projectile velocity is constant between Light Gate #1 and the SCR trigger point. A counter is start at ¼ the system clock frequency as the projectile passes light gate #1. When the projectile triggers light gate #2, the counter counts down at the clock frequency divided by a thumb wheel switch setting. When the counter reaches zero, the SCRs are triggered. In numerous firings from a variety of EMLs, the DDG has been reproducible to +/−¼ inch.

Clearly, many modifications and variations of the present invention are possible in light of the above teachings and it is therefore understood, that within the inventive scope of the inventive concept, the invention may be practiced otherwise than specifically claimed.

What is claimed is:

1. A system for the rapid firing of projectiles from an electromagnetic launcher, said launcher having a barrel and an armature in said barrel, said armature being rapidly translatable, when energized, on a plurality of rails for launching a projectile from said barrel, said system including a loader for serially loading a plurality of projectiles into said barrel, and means for preaccelerating said projectiles within said barrel, said system comprising:

a plurality of modules of electrolytic capacitors;

a plurality of modules of lead-acid batteries;

first switches for connecting each of said modules of batteries to said respective one of said modules of capacitors;

means in said launcher for sensing the presence of a projectile in said barrel;

second switches for connecting said capacitors to said electromagnetic launcher for energizing said launcher; and means responsive to the sensing of the presence of said projectile in said barrel for closing said second switches in response to said sensing of said projectile in said position within said launcher, whereby said capacitors are partially discharged and said launcher is energized.

2. The system of claim 1 wherein said projectiles are carried in a carrier; and wherein means are provided for ejecting a carrier from said barrel following the energizing of said launcher.

3. The system of claim 2, wherein said means for ejecting said carrier comprises a gas operated piston.

4. The system of claim 3, wherein the next one of said projectiles is loaded into said barrel following the ejecting of said carrier.

* * * * *